US011855370B2

(12) United States Patent
Chang et al.

(10) Patent No.: US 11,855,370 B2
(45) Date of Patent: Dec. 26, 2023

(54) POWER ADAPTER ASSEMBLY STRUCTURE

(71) Applicant: Delta Electronics, Inc., Taoyuan (TW)

(72) Inventors: Li-Yen Chang, Taoyuan (TW); Chin-Chu Huang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 129 days.

(21) Appl. No.: 17/550,501

(22) Filed: Dec. 14, 2021

(65) Prior Publication Data

US 2023/0116476 A1 Apr. 13, 2023

(30) Foreign Application Priority Data

Oct. 13, 2021 (CN) ..... 202111193797.8

(51) Int. Cl.
*H01R 13/66* (2006.01)
*H01R 12/71* (2011.01)
*H01R 13/24* (2006.01)

(52) U.S. Cl.
CPC ..... *H01R 12/714* (2013.01); *H01R 13/2407* (2013.01)

(58) Field of Classification Search
CPC .. H01R 12/714; H01R 13/2407; H01R 12/58; H01R 24/78; H01R 31/065; H01R 12/718; H01R 13/2442; H01R 12/7088
See application file for complete search history.

(56) References Cited

U.S. PATENT DOCUMENTS

| | | | | |
|---|---|---|---|---|
| 6,893,300 | B2 | 5/2005 | Zhou et al. | |
| 7,281,954 | B1 | 10/2007 | Hashiguchi | |
| 8,303,317 | B1 | 11/2012 | Gao et al. | |
| 9,537,276 | B1 | 1/2017 | Cai et al. | |
| 9,825,415 | B1 | 11/2017 | Lin et al. | |
| 10,601,194 | B1 * | 3/2020 | Chien | H01R 24/78 |
| 10,847,923 | B1 * | 11/2020 | Lin | H01R 13/514 |
| 2003/0153203 | A1 * | 8/2003 | Ketelsleger | H01R 12/58 439/82 |

(Continued)

FOREIGN PATENT DOCUMENTS

| | | | |
|---|---|---|---|
| CN | 2838098 | Y | 11/2006 |
| CN | 204304027 | U | 4/2015 |

(Continued)

*Primary Examiner* — Abdullah A Riyami
*Assistant Examiner* — Nelson R. Burgos-Guntin
(74) *Attorney, Agent, or Firm* — KIRTON McCONKIE; Evan R. Witt

(57) ABSTRACT

A power adapter assembly structure is disclosed and includes a circuit board, a socket and at least one elastic element. The socket is disposed adjacent to the circuit board. The circuit board and the socket are configured to collaboratively form at least one abutting surface and at least one fixing surface. The elastic element is connected between the circuit board and the socket, and includes a main body, a fixed portion and a hanging arm. The fixed portion and the hanging arm are disposed at two opposite ends of the main body, the fixed portion spatially corresponds to the fixing surface, and the hanging arm constantly abuts the abutting surface. A height is formed between the main body of the at least one elastic element and the at least one abutting surface, and less than a length of the hanging arm extended from the main body.

10 Claims, 14 Drawing Sheets

(56) References Cited

U.S. PATENT DOCUMENTS

| | | | | |
|---|---|---|---|---|
| 2006/0110963 | A1* | 5/2006 | Cheng | H01R 35/04 439/171 |
| 2007/0217631 | A1 | 9/2007 | Ho | |
| 2010/0151737 | A1* | 6/2010 | Hood, III | G06F 1/26 439/628 |
| 2011/0139592 | A1* | 6/2011 | Su | H01R 13/70 200/51.02 |
| 2012/0142208 | A1* | 6/2012 | Peng | H01R 31/06 439/345 |
| 2012/0208379 | A1 | 8/2012 | Lai | |
| 2014/0028417 | A1* | 1/2014 | Falchi | H01R 12/55 335/2 |
| 2015/0188265 | A1* | 7/2015 | Wang | H01R 13/6675 439/620.22 |
| 2015/0207271 | A1* | 7/2015 | Si | H01R 31/02 439/628 |
| 2015/0288112 | A1* | 10/2015 | Lee | H01R 12/53 439/660 |
| 2016/0261079 | A1* | 9/2016 | Lin | H01R 13/707 |
| 2016/0301154 | A1* | 10/2016 | Lee | H01R 13/4534 |
| 2017/0365947 | A1 | 12/2017 | Costello et al. | |
| 2018/0131109 | A1* | 5/2018 | Wang | H01R 12/7023 |
| 2018/0198235 | A1* | 7/2018 | Huang | H01R 13/6395 |
| 2018/0366871 | A1* | 12/2018 | Huang | H01R 4/4863 |
| 2019/0013629 | A1* | 1/2019 | Zhang | H01R 31/065 |
| 2019/0140397 | A1* | 5/2019 | Crowder | H01R 13/5825 |
| 2019/0207349 | A1* | 7/2019 | Yuan | H01R 13/631 |

FOREIGN PATENT DOCUMENTS

| | | | |
|---|---|---|---|
| CN | 204706684 | U | 10/2015 |
| CN | 206313675 | U | 7/2017 |
| CN | 207183692 | U | 4/2018 |
| CN | 112467451 | A | 3/2021 |
| CN | 213989296 | U | 8/2021 |
| JP | S5982980 | U | 6/1984 |
| TW | M327111 | U | 2/2008 |
| TW | 201544133 | A | 12/2015 |
| TW | I674716 | B | 5/2020 |
| TW | M609430 | U | 3/2021 |

* cited by examiner

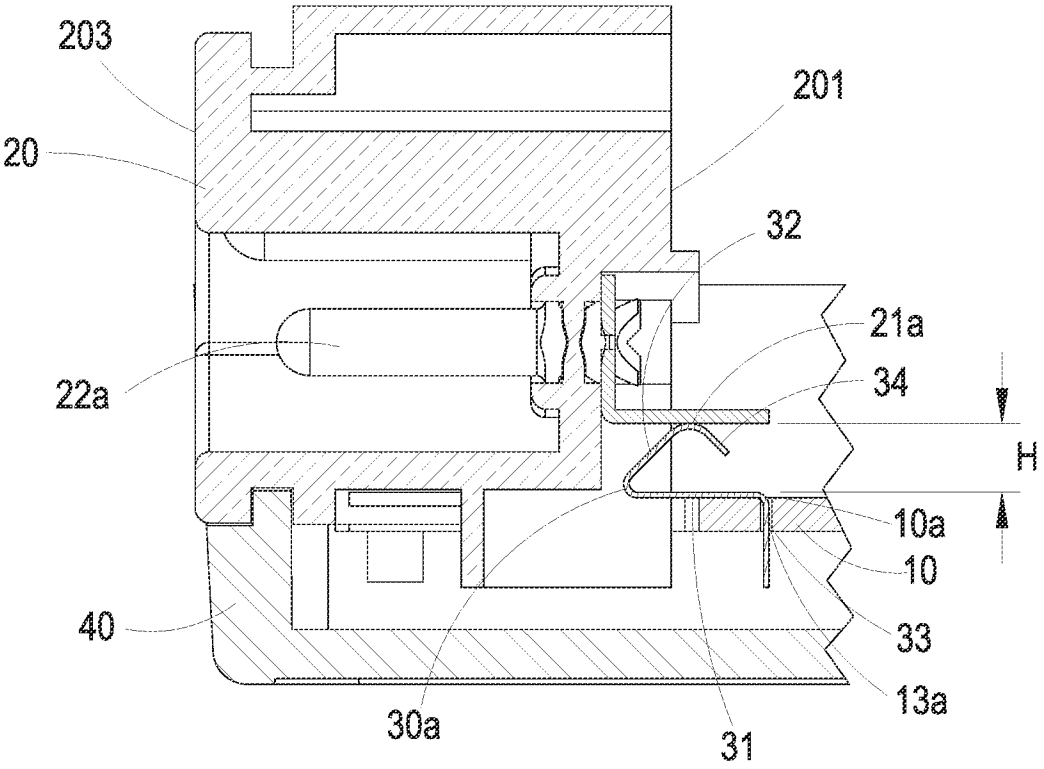
FIG. 5
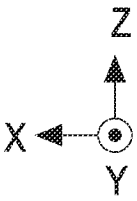

30a
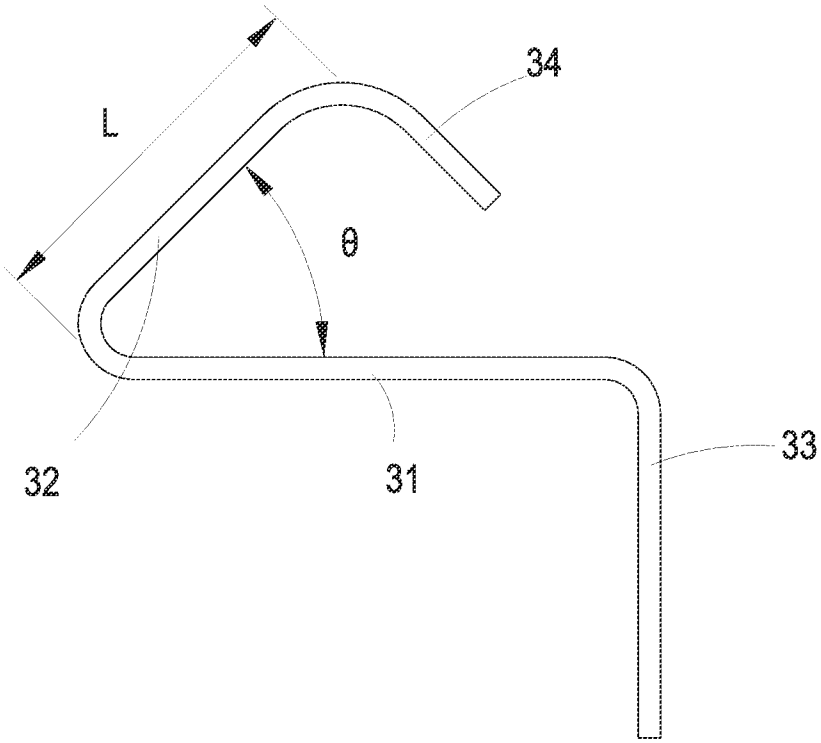
FIG. 6
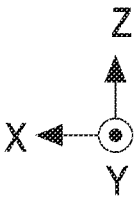

POWER ADAPTER ASSEMBLY STRUCTURE

FIELD OF THE INVENTION

The present disclosure relates to a power device, and more particularly to a power adapter assembly structure for simplifying the assembling procedure, realizing the automatic production, and avoiding the electrical interference at the same time.

BACKGROUND OF THE INVENTION

In current daily life, power conversion modules are required to provide the power for many electronic device applications. The power conversion module mainly includes a combination of a socket and a circuit board. The socket is used to connect to the conductive plug of the power supply, and the circuit board is connected to the socket. In that, the power conversion modules are configured to convert electrical energy and provide the required power to the electronic devices. Moreover, in the power conversion modules, the socket and the circuit board are connected through the leading wires.

Since the leading wires have to be welded manually after the socket and the circuit board are assembled, the conventional power conversion assembly structure is not conducive to the realization of the automated production. On the other hand, it is not easy to control the length change and direction of the wire connection. Furthermore, it is easy to cause the electrical electromagnetic interference (EMI) or the radio frequency interference (RFI) due to the crossing of the leading wires.

Therefore, there is a need of providing a power adapter assembly structure to simplify the assembling procedure of the socket and the circuit board, realize the automatic production, avoid the EMI/RFI due to the crossed leading wires, and obviate the drawbacks encountered by the prior arts.

SUMMARY OF THE INVENTION

An object of the present disclosure is to provide a power adapter assembly structure. By utilizing the elastic element to connect the socket and the circuit board, the assembling procedure is simplified, the automated production is realized, and the EMI/RFI caused by the crossed leading wires is avoided at the same time.

Another object of the present disclosure is to provide a power adapter assembly structure. With one-piece formed elastic element connected between a fixing surface and an abutting surface formed by the socket and the circuit board, a stable electronical connection of the socket and the circuit board is achieved. When the elastic element is pressed against the corresponding abutting surface constantly through the hanging arm thereof, the included angle between the hanging arm and the main body is for example an acute angle, so as to provide the elastic force and increase the structural strength. Since the hanging arm of the elastic element is pressed to constantly abut the corresponding abutting surface by the elastic force generated during assembling the socket and the circuit board, the assembling procedure of the socket and the circuit board is combined to realize the assembly structure of the socket, the circuit board and the elastic element by the automatic assembling equipment, and ensure the electrical connection between the socket and the circuit board.

A further object of the present disclosure is to provide a power adapter assembly structure. The elastic elements are configured to form the electrical connections between the socket and the circuit board, which are for example connected to the live wire, the neutral wire and the earth wire. Two elastic elements connected to the live wire and the neutral wire are led out from the rear side of the socket and arranged in parallel, so as to ensure that the minimum distance maintained between the two elastic elements meets the safety requirements for electrical clearance and creepage distance. In addition, the elastic element connected to the earth wire is led out from the lateral side of the socket to further ensure that the three elastic elements meet the safety requirements of electrical clearance and creepage distance. It avoids electrical EMI/RFI interference caused by crossed wires. On the other hand, since the electrical connections between the socket and the circuit board are realized through the elastic elements with structural strength, and integrated with the assembling procedure of the socket and the circuit board, it is more helpful to realize the assembly structure of the socket, the circuit board and the elastic elements by an automated production method. The assembling procedure is simplified, the production cost is reduced, and the competitiveness of the product is enhanced.

In accordance with an aspect of the present disclosure, a power adapter assembly structure is provided and includes a circuit board, a socket and at least one elastic element. The socket is disposed adjacent to the circuit board. The circuit board and the socket are configured to collaboratively form at least one abutting surface and at least one fixing surface. The at least one elastic element is connected between the circuit board and the socket, and includes a main body, a fixed portion and a hanging arm. The fixed portion and the hanging arm are disposed at two opposite ends of the main body, the fixed portion of the at least one elastic element spatially corresponds to the at least one fixing surface, and the hanging arm of the at least one elastic element constantly abuts the at least one abutting surface. A height is formed between the main body of the at least one elastic element and the at least one abutting surface, and the height is less than a length of the hanging arm extended from the main body.

In an embodiment, the power adapter assembly structure further includes a housing, wherein the circuit board and the socket are fastened on the housing, the at least one abutting surface is located at the socket, and the at least one fixing surface is located at the circuit board.

In an embodiment, the at least one abutting surface includes a live-wire abutting surface and a neutral-wire abutting surface located at a first side of the socket, and the at least one elastic element includes a first elastic element and a second elastic element, wherein the hanging arm of the first elastic element constantly abuts the live-wire abutting surface, and the hanging arm of the second elastic element constantly abuts against the neutral-wire abutting surface.

In an embodiment, the at least one fixing surface includes a live-wire fixing surface and a neutral-wire fixing surface located at a surface of the circuit board, and the fixed portion of the first elastic element is connected to the live-wire fixing surface, and the fixed portion of the second elastic element is connected to the neutral-wire fixing surface, wherein the first elastic element and the second elastic element are arranged parallel to each other.

In an embodiment, the at least one abutting surface further includes an earth-wire abutting surface located at a second side of the socket, and the at least one elastic element further includes a third elastic element, wherein the hanging arm of the third elastic element constantly abuts against the earth-wire abutting surface.

In an embodiment, the at least one fixing surface further includes an earth-wire fixing surface located at the surface of the circuit board, and the fixed portion of the third elastic element is connected to the earth-wire fixing surface.

In an embodiment, each of the live-wire abutting surface, the neutral-wire abutting surface and the earth-wire abutting surface is formed by a conductive metal sheet, wherein the socket further includes three conductive pins extended from the first side to a third side opposite to the first side, and the live-wire abutting surface, the neutral-wire abutting surface and the earth-wire abutting surface are electrically connected to the three conductive pins, respectively.

In an embodiment, the circuit board includes at least one perforation, and the fixed portion of the at least one elastic element is fixed on the circuit board through the perforation and electrically connected to the at least one fixing surface corresponding thereto.

In an embodiment, the power adapter assembly structure further includes a housing, wherein the circuit board and the socket are fastened on the housing, the at least one abutting surface is located at the circuit board, and the at least one fixing surface is located at the socket.

In an embodiment, the at least one abutting surface includes a live-wire abutting surface and a neutral-wire abutting surface located at a surface of the circuit board, and the at least one elastic element includes a first elastic element and a second elastic element, wherein the hanging arm of the first elastic element constantly abuts the live-wire abutting surface, and the hanging arm of the second elastic element constantly abuts against the neutral-wire abutting surface.

In an embodiment, the at least one fixing surface includes a live-wire fixing surface and a neutral-wire fixing surface located at a first side of the socket, and the fixed portion of the first elastic element is connected to the live-wire fixing surface, and the fixed portion of the second elastic element is connected to the neutral-wire fixing surface, wherein the first elastic element and the second elastic element are arranged parallel to each other.

In an embodiment, the at least one abutting surface further includes an earth-wire abutting surface located at the surface of the circuit board, and the at least one elastic element further includes a third elastic element, wherein the hanging arm of the third elastic element constantly abuts against the earth-wire abutting surface.

In an embodiment, the at least one fixing surface further includes an earth-wire fixing surface located at the first side of the socket, and the fixed portion of the third elastic element is connected to the earth-wire fixing surface.

In an embodiment, the main body of the third elastic element is extended from the first side to a second side, wherein the main body of the third elastic element, the main body of the second elastic element and the main body of the third elastic element are spaced apart from each other.

In an embodiment, the socket further includes three conductive pins extended from the first side to a third side opposite to the first side, and the live-wire fixing surface, the neutral-wire fixing surface and the earth-wire fixing surface are electrically connected to the three conductive pins, respectively.

In an embodiment, the hanging arm and the main body form an included angle, and the included angle is an acute angle.

In an embodiment, the at least one elastic element further includes an extension section connected to the hanging arm, and extended from the corresponding one of the at least one abutting surface toward the main body.

BRIEF DESCRIPTION OF THE DRAWINGS

The above contents of the present disclosure will become more readily apparent to those ordinarily skilled in the art after reviewing the following detailed description and accompanying drawings, in which:

FIG. 5 is a vertical cross-sectional view illustrating the power adapter assembly structure according to the first embodiment of the present disclosure;

FIG. 6 is an exemplary structural view illustrating the elastic element of the power adapter assembly structure according to the first embodiment of the present disclosure;

DETAILED DESCRIPTION OF THE PREFERRED EMBODIMENT

Figure 1:
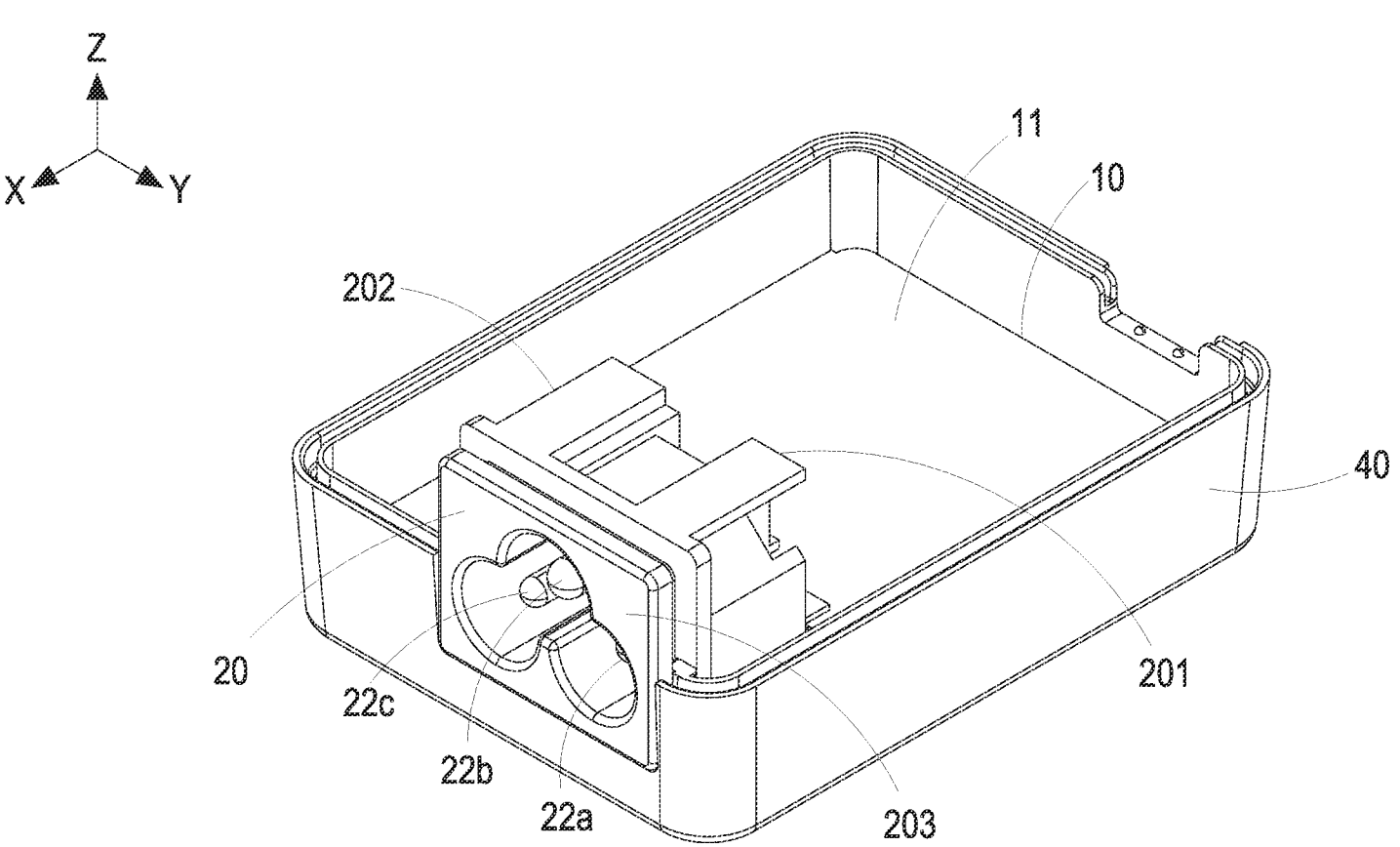
FIG. 1 is a perspective view illustrating a power adapter assembly structure according to a first embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected," or "coupled," to another element, it can be directly connected or coupled to the other element or intervening elements may be present. Although the wide numerical ranges and parameters of the present disclosure are approximations, numerical values are set forth in the specific examples as precisely as possible. In addition, although the "first," "second," "third," and the like terms in the claims be used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments. Besides, "and/or" and the like may be used herein for including any or all combinations of one or more of the associated listed items. Alternatively, the word "about" means within an acceptable standard error of ordinary skill in the art-recognized average. In addition to the operation/working examples, or unless otherwise specifically stated otherwise, in all cases, all of the numerical ranges, amounts, values and percentages, such as the number for the herein disclosed materials, time duration, temperature, operating conditions, the ratio of the amount, and the like, should be understood as the word "about" decorator. Accordingly, unless otherwise indicated, the numerical parameters of the present invention and scope of the appended patent proposed is to follow changes in the desired approximations. At least, the number of significant digits for each numerical parameter should at least be reported and explained by conventional rounding technique is applied. Herein, it can be expressed as a range between from one endpoint to the other or both endpoints. Unless otherwise specified, all ranges disclosed herein are inclusive.

Figure 2:
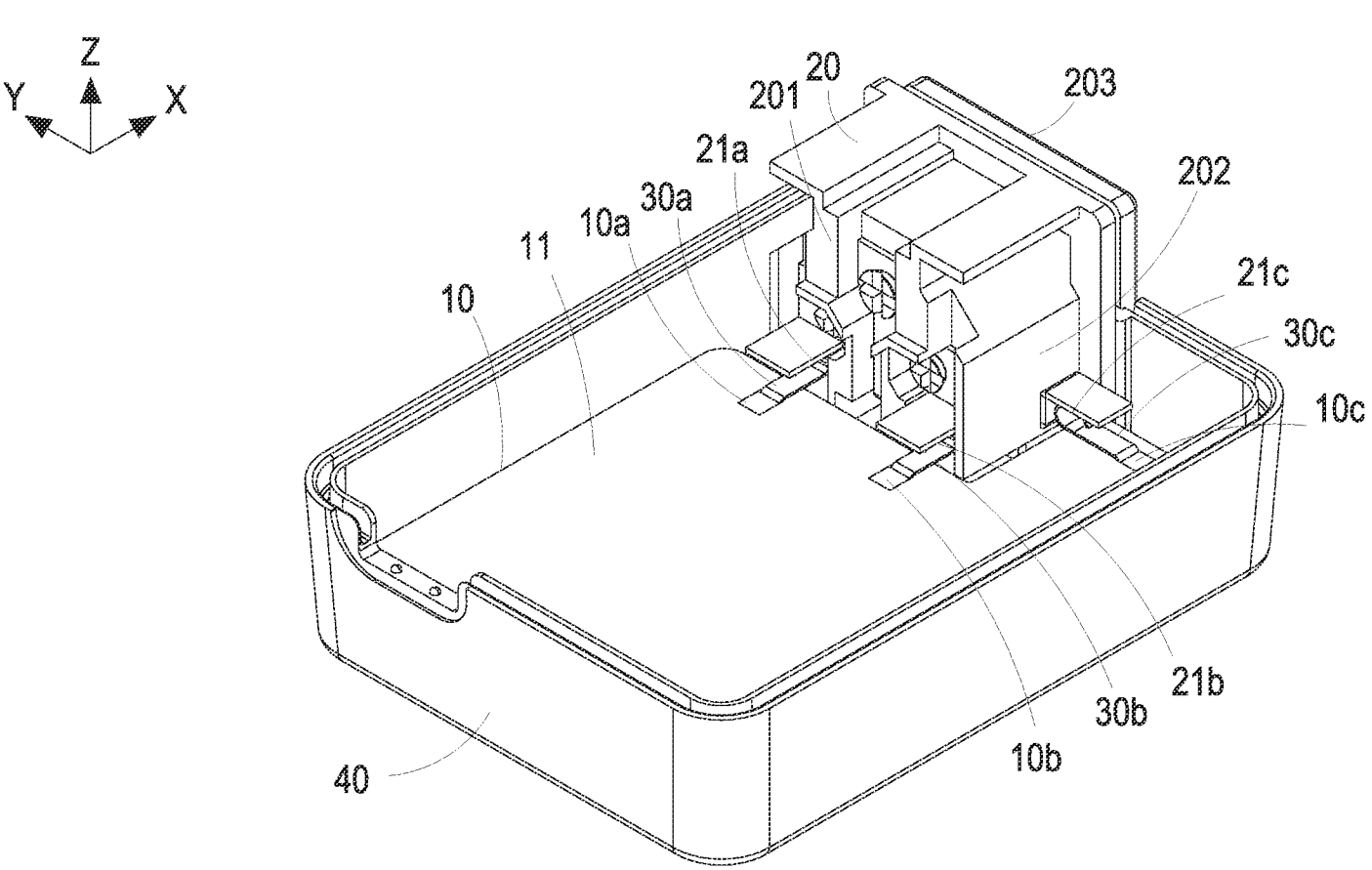
FIG. 2 is a perspective view illustrating the power adapter assembly structure according to the first embodiment of the present disclosure and taken from another perspective.
Figure 3:
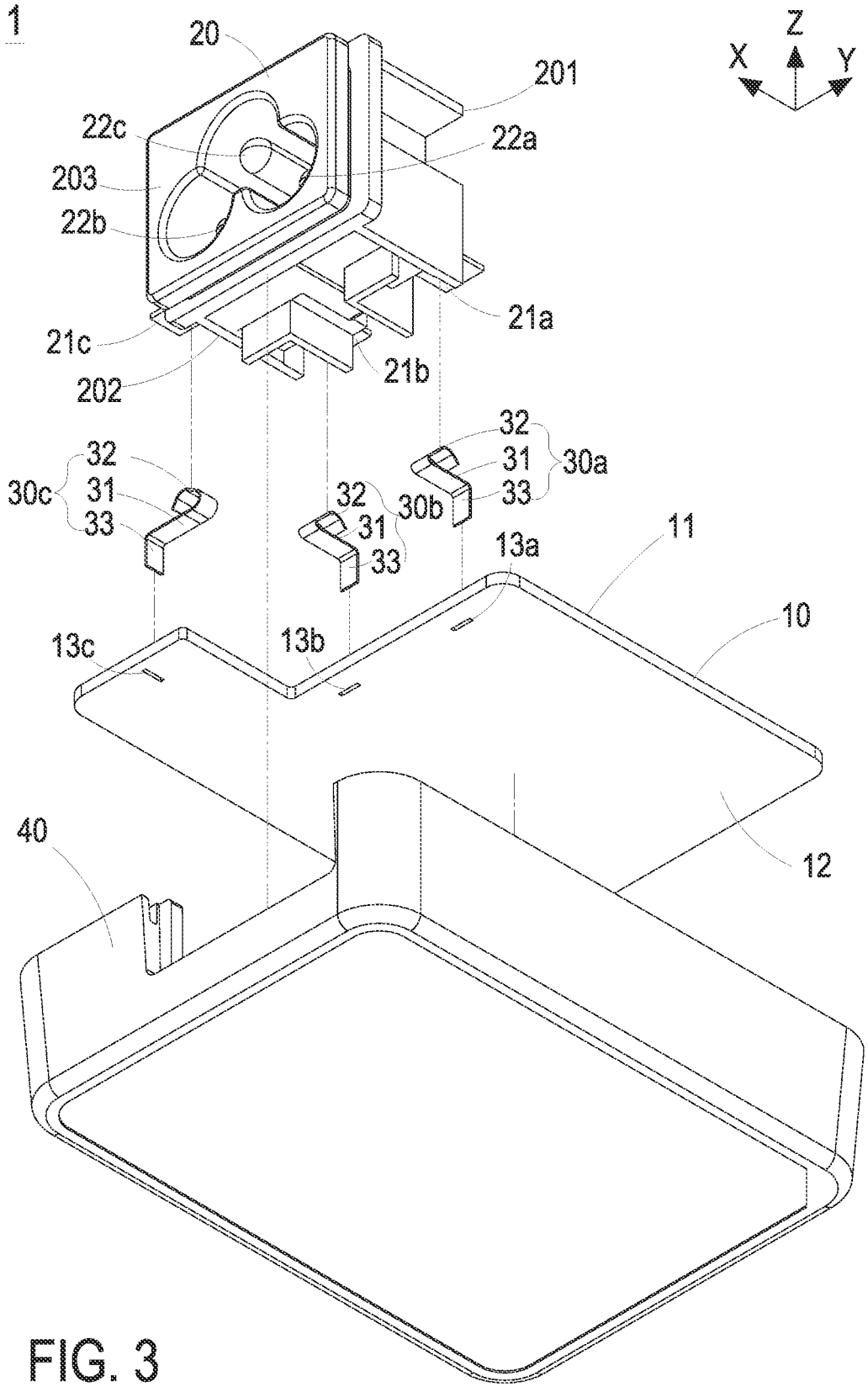
FIG. 3 is an exploded view illustrating the power adapter assembly structure according to the first embodiment of the present disclosure.
Figure 4:
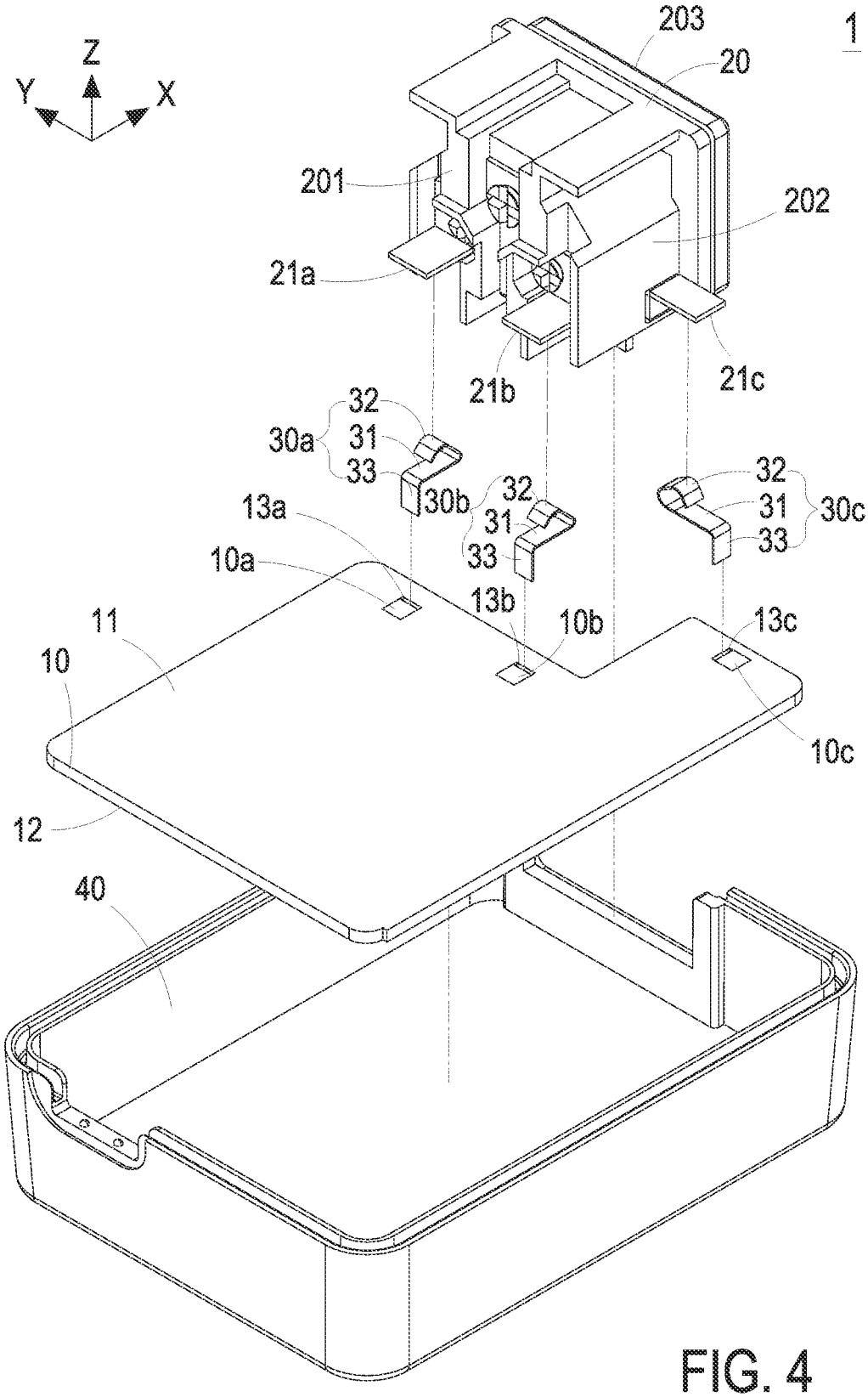
FIG. 4 is an exploded view illustrating the power adapter assembly structure according to the first embodiment of the present disclosure and taken from another perspective.
Figure 7:
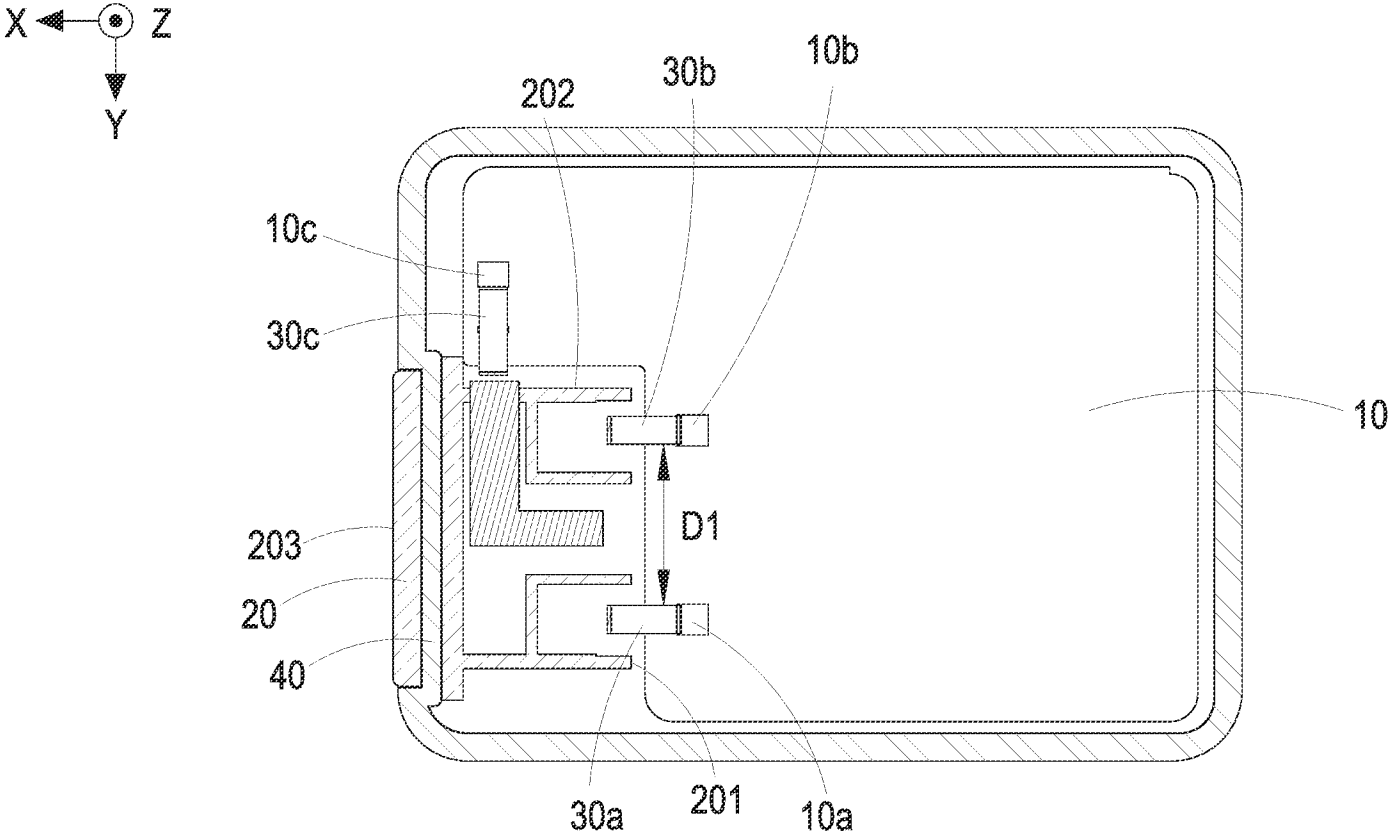
FIG. 7 is a horizontal cross-sectional view illustrating the power adapter assembly structure according to the first embodiment of the present disclosure.

FIGS. 1 and 2 are perspective views illustrating a power adapter assembly structure according to a first embodiment of the present disclosure. FIGS. 3 and 4 are exploded views illustrating the power adapter assembly structure according to the first embodiment of the present disclosure. FIG. 5 is a vertical cross-sectional view illustrating the power adapter assembly structure according to the first embodiment of the present disclosure. FIG. 6 is an exemplary structural view illustrating the elastic element of the power adapter assembly structure according to the first embodiment of the present disclosure. FIG. 7 is a horizontal cross-sectional view illustrating the power adapter assembly structure according to the first embodiment of the present disclosure. In the embodiment, the power adapter assembly structure 1 includes a circuit board 10, a socket 20 and at least one elastic element. Preferably but not exclusively, the at least one elastic element is any one of a first elastic element 30*a*, a second elastic element 30*b* and a third elastic element 30*c*. Preferably but not exclusively, the socket 20 and the circuit board 10 are fixed on a housing 40, and the socket 20 is disposed adjacent to the circuit board 10. In the embodiment, when the circuit board 10 and the socket 20 are fixed on the housing 40, the circuit board 10 and the socket 20 are configured to collaboratively form at least one abutting surface and at least one fixing surface. Preferably but not exclusively, in the embodiment, the at least one abutting surface includes a live-wire abutting surface 21*a*, a neutral-wire abutting surface 21*b* and an earth-wire abutting surface 21*c*. The live-wire abutting surface 21*a* and the neutral-wire abutting surface 21*b* are disposed adjacent to a first side 201 of the socket 20, and the earth-wire abutting surface 21*c* is disposed adjacent to a second side 202 of the socket 20. Preferably but not exclusively, the at least one fixing surface includes a live-wire fixing surface 10*a*, a neutral-wire fixing surface 10*b* and an earth-wire fixing surface 10*c*, which are disposed on a top surface 11 of the circuit board 10. The first elastic element 30*a*, the second elastic element 30*b* and the third elastic element 30*c* are connected between the circuit board 10 and the socket 20, respectively. In the embodiment, the first elastic element 30*a*, the second elastic element 30*b* and the third elastic element 30*c* have the same or similar structure, and each of which includes a main body 31, a fixed portion 33 and a hanging arm 32. The fixed portion 33 and the hanging arm 32 are disposed at two opposite ends of the main body 31. The fixed portion 33 of the first elastic element 30*a* spatially corresponds to the live-wire fixing surface 10*a*, and the hanging arm 32 of the first elastic element 30*a* constantly abuts the live-wire abutting surface 21*a*. The fixed portion 33 of the second elastic element 30*b* spatially corresponds to the neutral-wire fixing surface 10*b*, and the hanging arm 32 of the second elastic element 30*b* constantly abuts the neutral-wire abutting surface 21*b*. The fixed portion 33 of the third elastic element 30*c* spatially corresponds to the earth-wire fixing surface 10*c*, and the hanging arm 32 of the third elastic element 30*c* constantly abuts the earth-wire abutting surface 21*c*. It should be noted that the corresponding relationships of the first elastic element 30*a*, the second elastic element 30*b*, and the third elastic element 30*c* connected between the circuit board 10 and the socket 20 are merely illustrative. Taking the first elastic element 30*a* as an example for illustration, a height H is formed between the main body 31 of the first elastic element 30*a* and the corresponding live-wire abutting surface 21*a*, as shown in FIG. 5. In addition, the hanging arm 32 of the first elastic element 30*a* is extended from the main body 31 to form a length L of the hanging arm 32, as shown in FIG. 6. In the embodiment, the height H is less than the length L of the hanging arm 32. In that, when the socket 20 and the circuit board 10 are fixed to the housing 40, the hanging arm 32 of the first elastic element 30*a* is pressed to generate an elastic force against the corresponding live-wire abutting surface 21*a*. The second elastic element 30*b* and the third elastic element 30*c* are also connected between the circuit board 10 and the socket 20 in the same manner.

Preferably but not exclusively, in the embodiment, each of the first elastic element 30*a*, the second elastic element 30*b* and the third elastic element 30*c* is integrally formed into one piece by a conductive metal sheet. The first elastic element 30*a* is connected between the live-wire fixing surface 10*a* of the circuit board 10 and the live-wire abutting surface 21*a* of the socket 20. The second elastic element 30*b* is connected between the neutral-wire fixing surface 10*b* of the circuit board 10 and the neutral abutting surface 21*b* of the socket 20. The third elastic element 30*c* is connected between the earth-wire fixing surface 10*c* of the circuit board 10 and the earth-wire abutting surface 21*c* of the socket 20. Whereby, a stable electrical connection between the socket 20 and the circuit board 10 is achieved. The first elastic element 30*a* is taken as the example for illustration. When the circuit board 10 and the socket 20 are fixed to the housing 40, the hanging arm 32 of the first elastic element 30*a* is pressed by the socket 20 and the circuit board 10 during assembling, and an elastic force is generated to constantly abut the corresponding live-wire abutting surface 21*a*. Therefore, the installation procedure of the first elastic element 30*a*, the second elastic element 30*b* and the third elastic element 30*c* is combined with the assembling procedure of the socket 20 and the circuit board 10, so as to realize the power adapter assembly structure 1 of the socket 20, the circuit board 10, the first elastic element 30*a*, the second elastic element 30*b* and the third elastic element 30*c* by the automatic assembling equipment, and ensure the electrical connection between the socket 20 and the circuit board 10.

Moreover, in the embodiment, taking the first elastic element 30*a* as the example for illustration, the hanging arm 32 and the main body 31 form an included angle θ. Preferably but not exclusively, the included angle θ is an acute angle ranged from 1° to 89°, so as to provide the elastic force and increase the structural strength. It is helpful to combine the assembling procedure of the socket 20 and the circuit board 10 to realize the power adapter assembly structure 1. In the embodiment, the first elastic element 30*a* further includes an extension section 34, which is connected to the hanging arm 32 and extended from the corresponding live-wire abutting surface 21*a* toward the main body 31, so as to facilitate the hanging arm 32 to firmly abut against the live-wire abutting surface 21*a* and increase the structural strength of the first elastic element 30*a*. Certainly, the present disclosure is not limited thereto. In the embodiment, the circuit board 10 includes at least one perforation 13*a*, 13*b*, 13*c*. Preferably but not exclusively, the fixed portion 33 of the first elastic element 30*a* is fixed to the circuit board 10 through the perforation 13*a*, and is electrically connected to the live-wire fixing surface 10*a*. The fixed portion 33 of the second elastic element 30*b* is fixed to the circuit board 10 through the perforation 13*b*, and is electrically connected to the neutral-wire fixing surface 10*b*. The fixed portion 33 of the third elastic element 30*c* is fixed to the circuit board 10 through the perforation 13*c*, and is electrically connected to the earth-wire fixing surface 10*c*. The length, the shape and the angle of the fixed portion 33 relative to the main body 31 are adjustable according to the practical requirements. Preferably but not exclusively, the fixed portion 33 is fixed to the circuit board 10 by welding. In the embodiment, the live-wire fixing surface 10*a*, the neutral-wire fixing surface 10*b* and the earth-wire fixing surface 10*c* are located on the top surface 11 of the circuit board 10, and are connected to the corresponding fixed portions 33 by welding, respectively. Preferably but not exclusively, in other embodiments, the live-wire fixing surface 10*a*, the neutral-wire fixing surface 10*b*, and the earth-wire fixing surface 10*c* are located on the bottom surface 12 of the circuit board 10, and are connected to the corresponding fixed portions 33 by welding, respectively. The present disclosure is not limited thereto.

In the embodiment, the live-wire fixing surface 21*a* and the neutral-wire fixing surface 21*b* of the socket 20 are located at the first side 201 of the socket 20. Preferably but not exclusively, the first side 201 is the rear side. The earth-wire fixing surface 21*c* of the socket 20 is located at the second side 202 of the socket 20. Preferably but not exclusively, the second side 202 is the lateral side. In the embodiment, the first elastic element 30*a* connected to the live-wire abutting surface 21*a* and the second elastic element 30*b* connected to the neutral-wire abutting surface 21*b* are led out from the first side 201 of the socket 20 and arranged in parallel to the X-axis direction. A minimum distance D1 is maintained between the first elastic element 30*a* and the second elastic element 30*b*, so as to ensure that the minimum distance D1 maintained between the first elastic element 30*a* and the second elastic element 30*b* meets the safety requirements for electrical clearance and creepage distance. Moreover, in the embodiment, the third elastic element 30*c* connected to the earth-wire abutting surface 21*c* is led out from the second side 202 of the socket 20 and arranged along the Y-axis direction. The main body 31 of the first elastic element 30*a*, the main body 31 of the second elastic element 30*b*, and the main body 31 of the third elastic element 30*c* are spaced apart from each other, to further ensure that the first elastic element 30*a*, the second elastic element 30*b* and the third elastic element 30*c* meet the safety requirements of electrical clearance and creepage distance. It avoids electrical EMI/RFI interference caused by crossed wires. In the embodiment, each of the live-wire abutting surface 21*a*, the neutral-wire abutting surface 21*b* and the earth-wire abutting surface 21*c* is formed by a conductive metal sheet. The socket 20 further includes three conductive pins. Preferably but not exclusively, the three conductive pins include a live-wire pin 22*a*, a neutral-wire pin 22*b* and an earth-wire pin 22*c* extended from the first side 201 to a third side 203 opposite to the first side 201, along the X-axis direction. Preferably but not exclusively, the live-wire pin 22*a*, the neutral-wire pin 22*b*, and the earth-wire pin 22*c* are electrically connected to the conductive metal sheets of the live-wire abutting surface 21*a*, the neutral-wire abutting surface 21*b*, and the earth-wire abutting surface 21*c* by riveting, respectively.

In the embodiment, the first elastic element 30*a*, the second elastic element 30*b*, and the third elastic element 30*c* are pre-fixed to the circuit board 10 through the fixing portions 33 thereof, respectively. When the circuit board 10 and the socket 20 are fixed to the housing 40, the live-wire abutting surface 21*a*, the neutral-wire abutting surface 21*b* and the earth-wire abutting surface 21*c* of the socket 20 push the hanging arms 32 of the first elastic element 30*a*, the second elastic element 30*b* and the third elastic element 30*c*, respectively, in the Z-axis direction, so as to complete the assembling procedure of the power adapter assembly structure 1. Since the electrical connection between the socket 20 and the circuit board 10 is achieved through the first elastic element 30*a*, the second elastic element 30*b* and the third elastic element 30*c* with structural strength, combined with the assembling procedure of the socket 20 and the circuit board 10, it is more helpful to realize the power adapter assembly structure 1 of the socket 20, the circuit board 10, the first elastic element 30*a*, the second elastic element 30*b* and the third elastic element 30*c* by an automated production method. The assembling procedure is simplified, the production cost is reduced, and the competitiveness of the product is enhanced.

Figure 8:
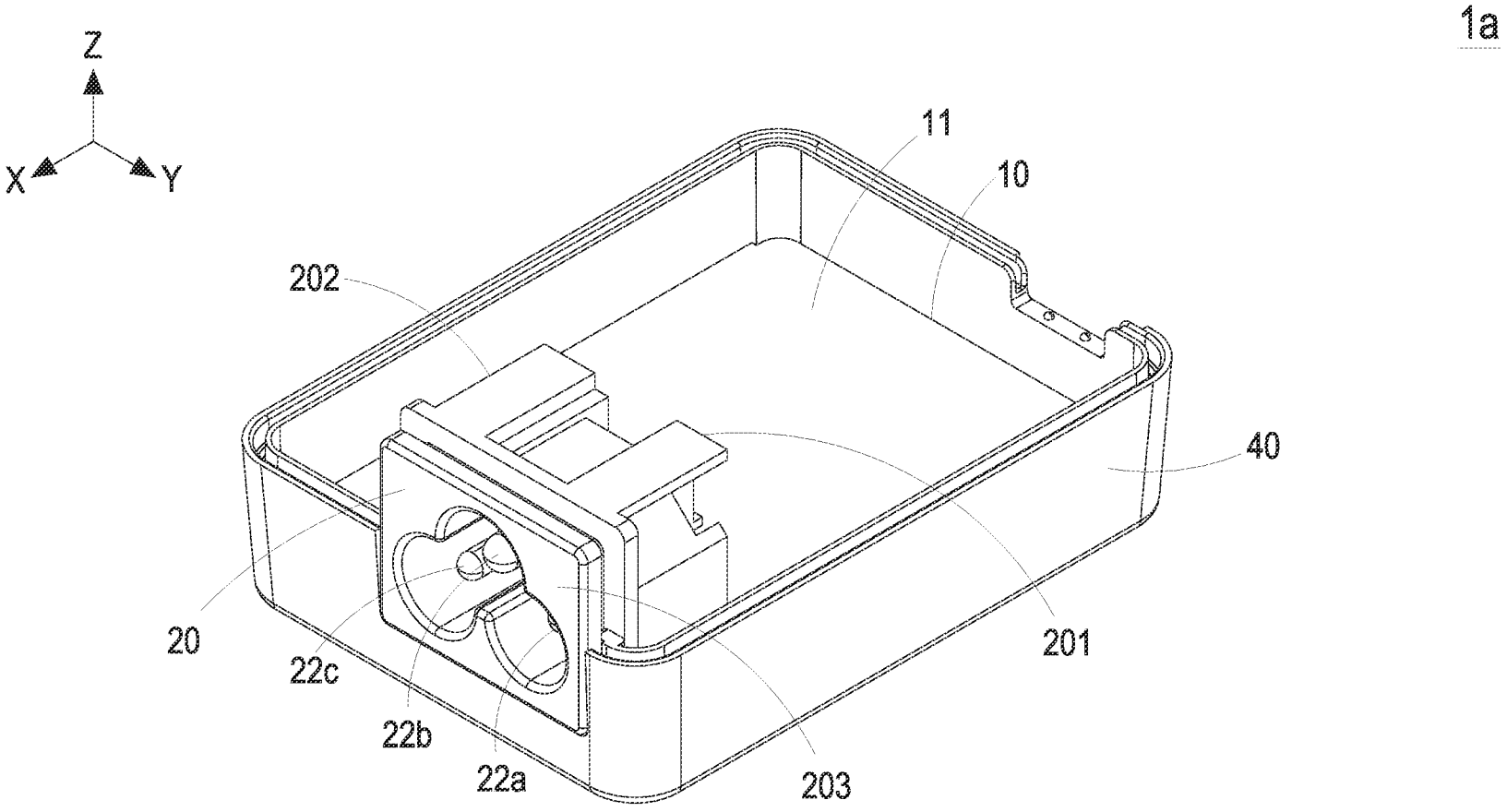
FIG. 8 is a perspective view illustrating a power adapter assembly structure according to a second embodiment of the present disclosure.
Figure 9:
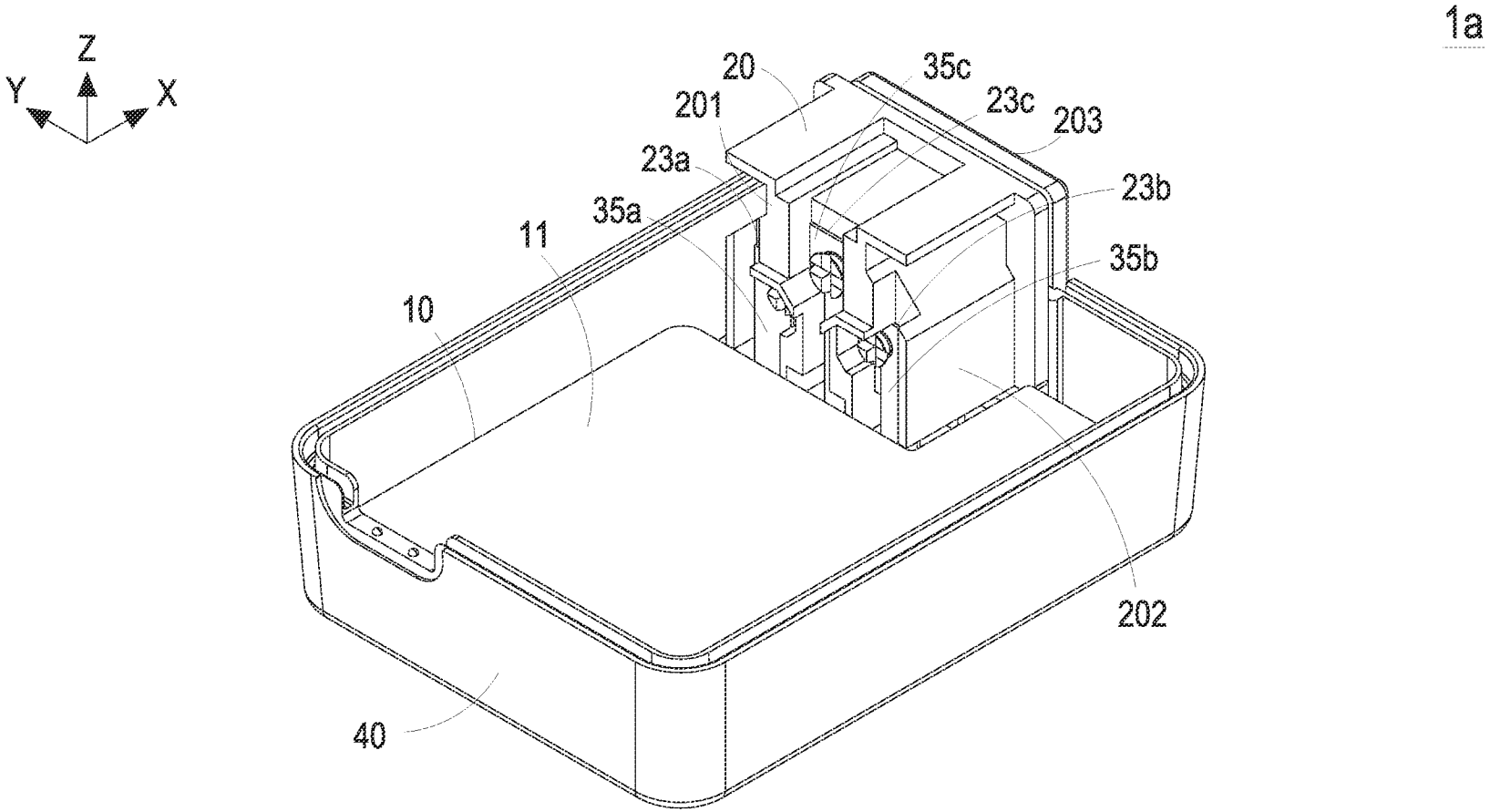
FIG. 9 is a perspective view illustrating the power adapter assembly structure according to the second embodiment of the present disclosure and taken from another perspective.
Figure 10:
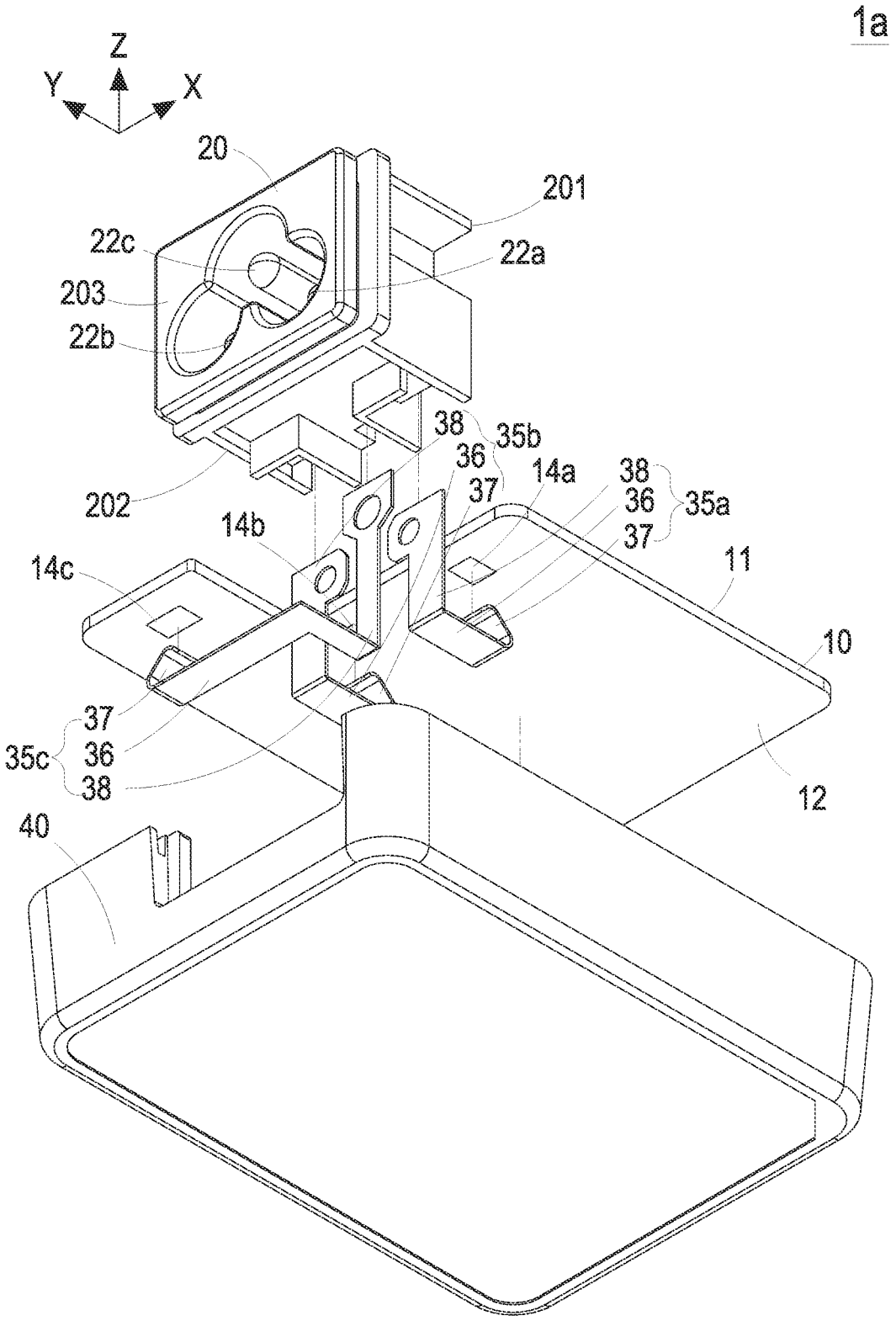
FIG. 10 is an exploded view illustrating the power adapter assembly structure according to the second embodiment of the present disclosure.
Figure 11:
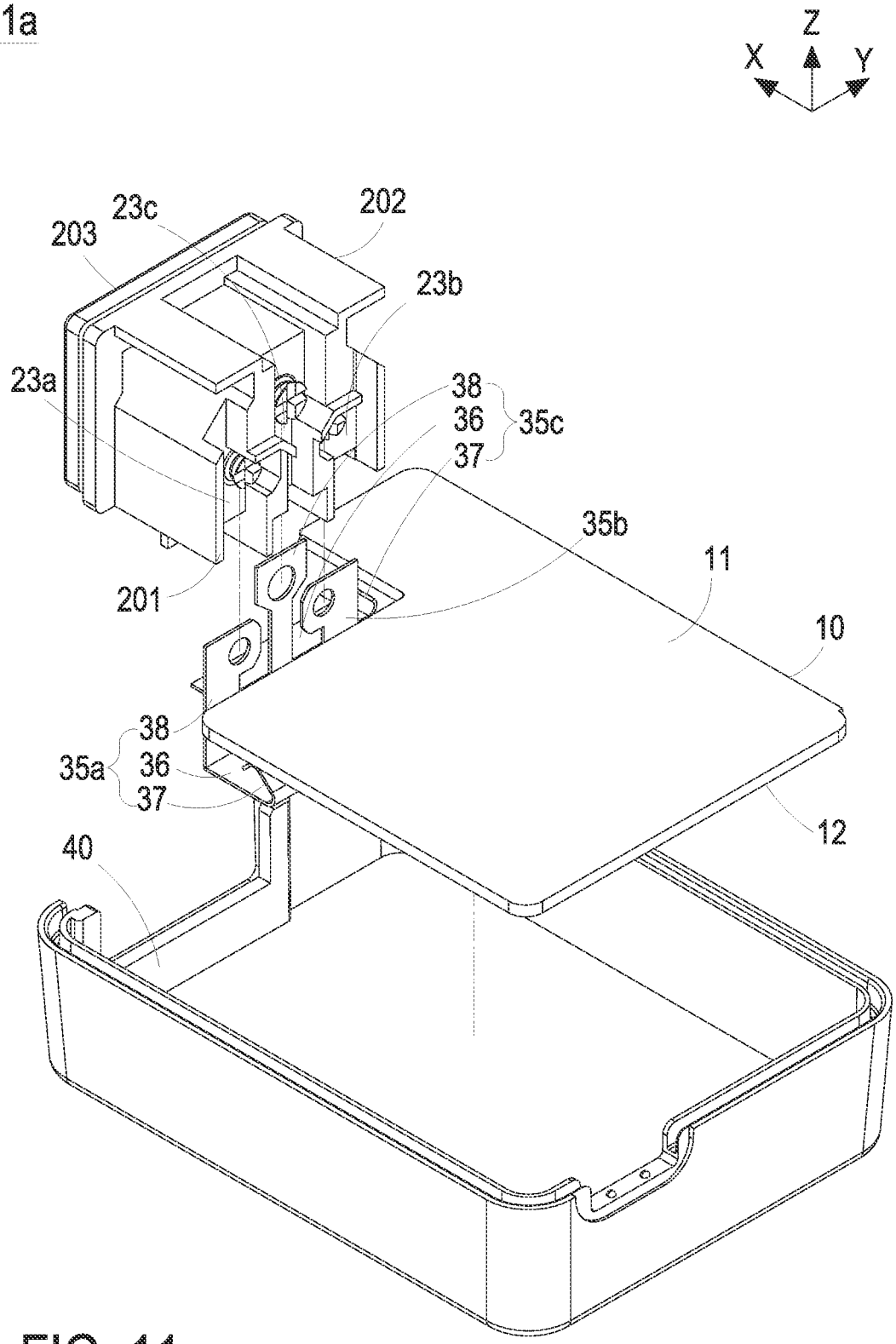
FIG. 11 is an exploded view illustrating the power adapter assembly structure according to the second embodiment of the present disclosure and taken from another perspective.
Figure 12:
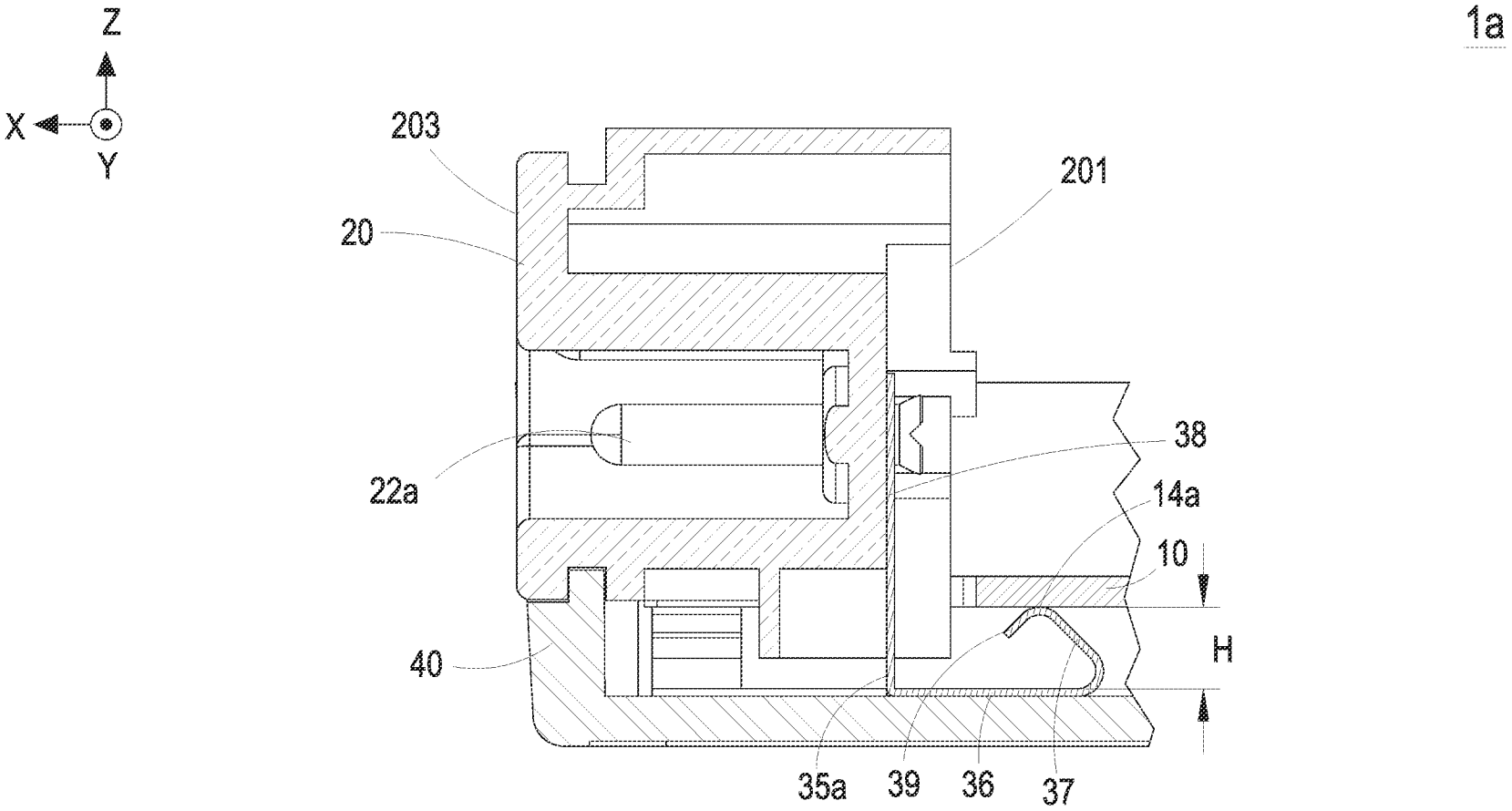
FIG. 12 is a vertical cross-sectional view illustrating the power adapter assembly structure according to the second embodiment of the present disclosure.
Figure 13:
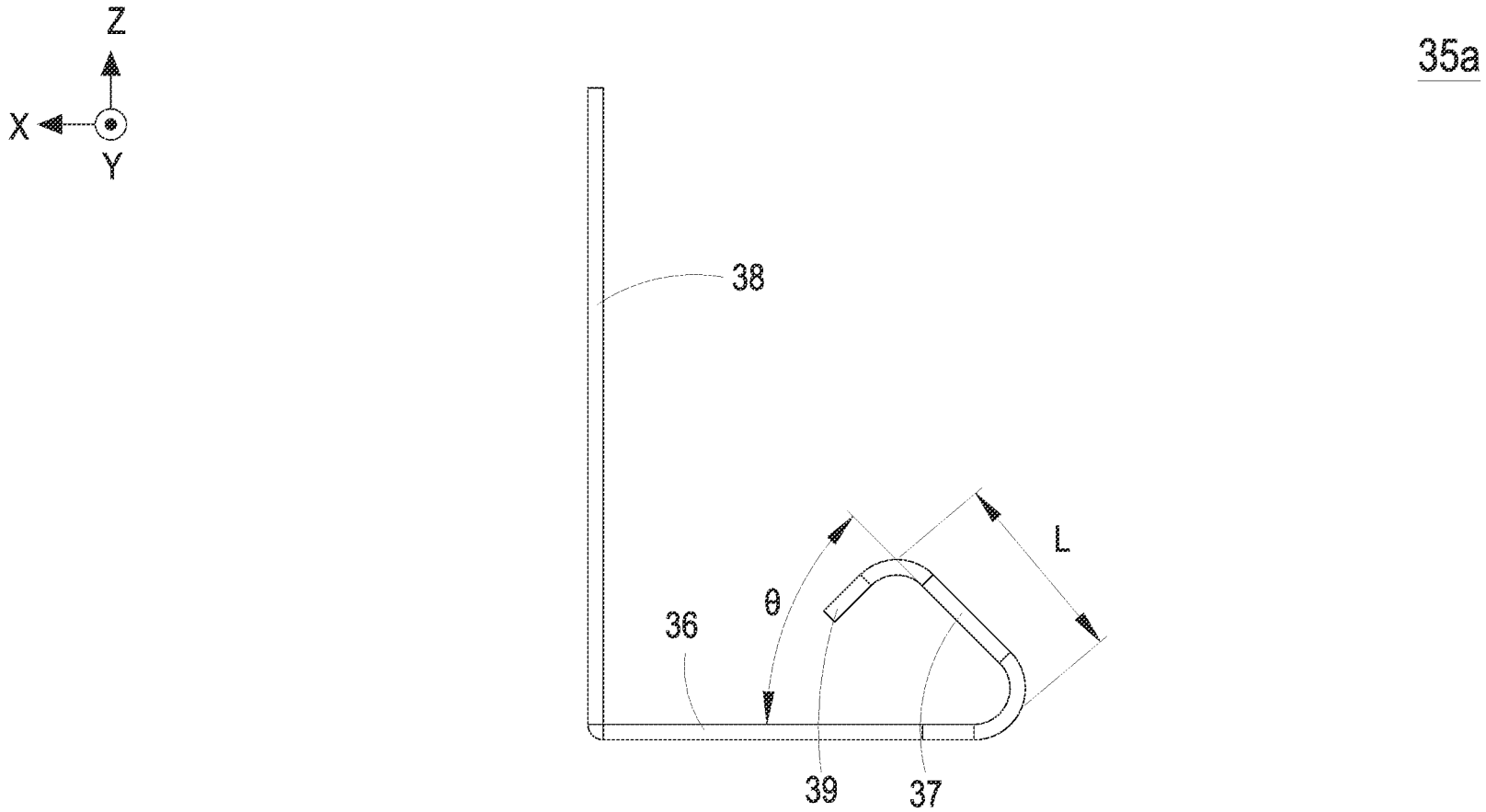
FIG. 13 is an exemplary structural view illustrating the elastic element of the power adapter assembly structure according to the second embodiment of the present disclosure.
Figure 14:
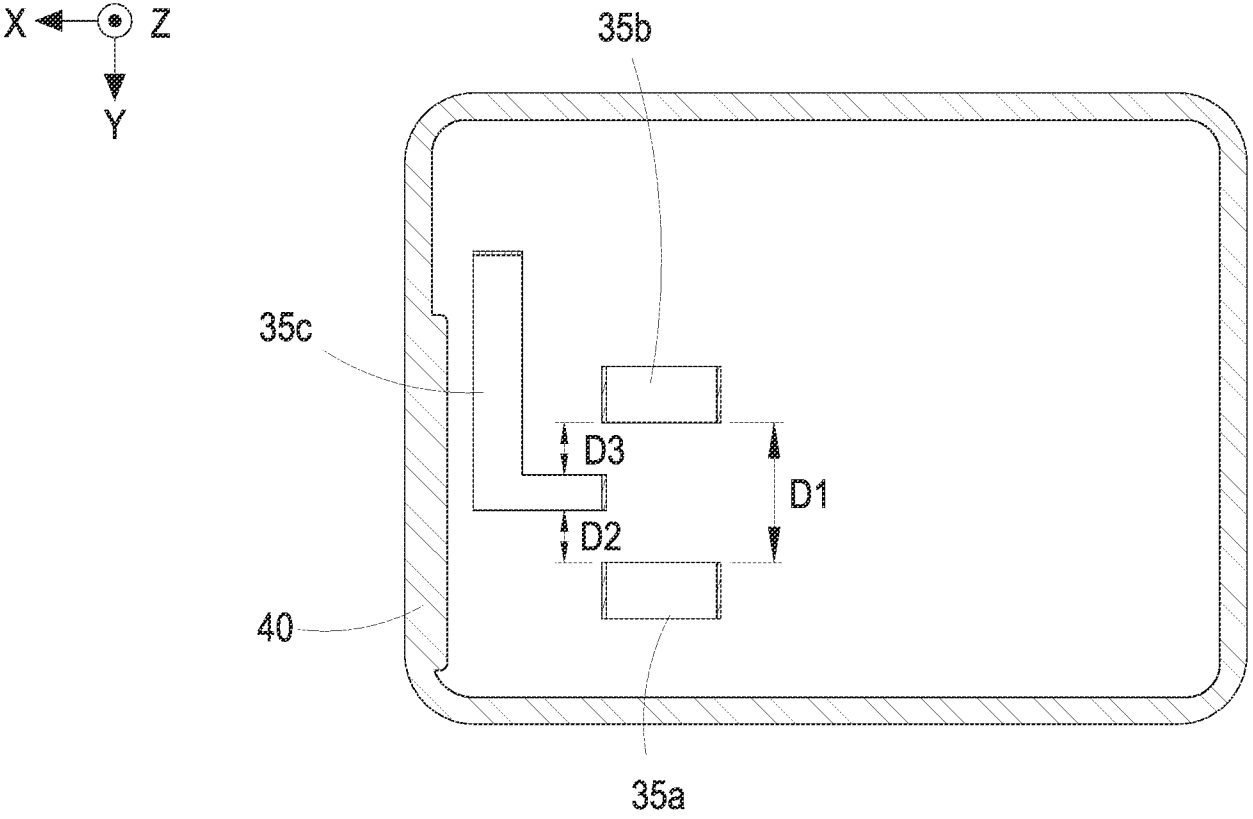
FIG. 14 is a horizontal cross-sectional view illustrating the power adapter assembly structure according to the first embodiment of the present disclosure.

FIGS. 8 and 9 are perspective views illustrating a power adapter assembly structure according to a second embodiment of the present disclosure. FIGS. 10 and 11 are exploded views illustrating the power adapter assembly structure according to the second embodiment of the present disclosure. FIG. 12 is a vertical cross-sectional view illustrating the power adapter assembly structure according to the second embodiment of the present disclosure. FIG. 13 is an exemplary structural view illustrating the elastic element of the power adapter assembly structure according to the second embodiment of the present disclosure. FIG. 14 is a horizontal cross-sectional view illustrating the power adapter assembly structure according to the first embodiment of the present disclosure. In the embodiment, the structures, elements and functions of the power adapter assembly structure 1*a* are similar to those of the power adapter assembly structure 1 of FIGS. 1 to 7, and are not redundantly described herein. In the embodiment, the power adapter assembly structure 1*a* includes a circuit board 10, a socket 20, a first elastic element 35*a*, a second elastic element 35*b* and a third elastic element 35*c*. The socket 20 and the circuit board 10 are fixed on a housing 40, and the socket 20 is disposed adjacent to the circuit board 10. In the embodiment, when the circuit board 10 and the socket 20 are fixed on the housing 40, the circuit board 10 and the socket 20 are configured to collaboratively form at least one abutting surface and at least one fixing surface. Preferably but not exclusively, in the embodiment, the at least one abutting surface includes a live-wire abutting surface 14*a*, a neutral-wire abutting surface 14*b* and an earth-wire abutting surface 14*c*, which are disposed on the bottom surface 12 of the circuit board 10. Preferably but not exclusively, the at least one fixing surface includes a live-wire fixing surface 23*a*, a neutral-wire fixing surface 23*b* and an earth-wire fixing surface 23*c*, which are disposed on the first side 201 of the socket 20. The first elastic element 35*a*, the second elastic element 35*b* and the third elastic element 35*c* are connected between the circuit board 10 and the socket 20, respectively. In the embodiment, the first elastic element 35*a*, the second elastic element 35*b* and the third elastic element 35*c* have the same or similar structure, and each of which includes a main body 36, a fixed portion 38 and a hanging arm 37. The fixed portion 38 and the hanging arm 37 are disposed at two opposite ends of the main body 36. The fixed portion 38 of the first elastic element 35*a* spatially corresponds to the live-wire fixing surface 23*a*, and the hanging arm 37 of the first elastic element 35*a* constantly abuts the live-wire abutting surface 14*a*. The fixed portion 38 of the second elastic element 35*b* spatially corresponds to the neutral-wire fixing surface 23*b*, and the hanging arm 37 of the second elastic element 35*b* constantly abuts the neutral-wire abutting surface 14*bb*. The fixed portion 38 of the third elastic element 35*c* spatially corresponds to the earth-wire fixing surface 23*c*, and the hanging arm 37 of the third elastic element 35*c* constantly abuts the earth-wire abutting surface 14*c*. It should be noted that the corresponding relationships of the first elastic element 35*a*, the second elastic element 35*b*, and the third elastic element 35*c* connected between the circuit board 10 and the socket 20 are merely illustrative. Taking the first elastic element 35*a* as an example for illustration, a height H is formed between the main body 36 of the first elastic element 35*a* and the corresponding live-wire abutting surface 14*a*, as shown in FIG. 12. In addition, the hanging arm 37 of the first elastic element 35*a* is extended from the main body 36 to form a length L of the hanging arm 37, as shown in FIG. 13. In the embodiment, the height H is less than the length L of the hanging arm 37. In that, when the socket 20 and the circuit board 10 are fixed to the housing 40, the hanging arm 37 of the first elastic element 35*a* is pressed to generate an elastic force against the corresponding live-wire abutting surface 14*a*. The second elastic element 35*b* and the third elastic element 35*c* are also connected between the circuit board 10 and the socket 20 in the same manner.

Preferably but not exclusively, in the embodiment, each of the first elastic element 35*a*, the second elastic element 35*b* and the third elastic element 35*c* is integrally formed into one piece by a conductive metal sheet. The first elastic element 35*a* is connected between the live-wire abutting surface 14*a* of the circuit board 10 and the live-wire fixing surface 23*a* of the socket 20. The second elastic element 35*b* is connected between the neutral-wire abutting surface 14*b* of the circuit board 10 and the neutral fixing surface 23*b* of the socket 20. The third elastic element 35*c* is connected between the earth-wire abutting surface 14*c* of the circuit board 10 and the earth-wire fixing surface 23*c* of the socket 20. Whereby, a stable electrical connection between the socket 20 and the circuit board 10 is achieved. The first elastic element 35*a* is taken as the example for illustration. The first elastic element 35*a* is pre-fixed on the socket 20. When the circuit board 10 and the socket 20 are fixed to the housing 40, the hanging arm 37 of the first elastic element 35*a* is pressed by the circuit board 10 during assembling, and an elastic force is generated to constantly abut the corresponding live-wire abutting surface 14*a*. Therefore, the first elastic element 35*a*, the second elastic element 35*b* and the third elastic element 35*c* are pre-fixed on the socket 20 and combined with the assembling procedure of the socket 20 and the circuit board 10, so as to realize the power adapter assembly structure 1*a* of the socket 20, the circuit board 10, the first elastic element 35*a*, the second elastic element 35*b* and the third elastic element 35*c* by the automatic assembling equipment, and ensure the electrical connection between the socket 20 and the circuit board 10.

In the embodiment, taking the first elastic element 35*a* as the example for illustration, the hanging arm 37 and the main body 36 form an included angle θ. Preferably but not exclusively, the included angle θ is an acute angle ranged from 1° to 89°, so as to provide the elastic force and increase the structural strength. It is helpful to combine the assembling procedure of the socket 20 and the circuit board 10 to realize the power adapter assembly structure 1*a*. In the embodiment, the first elastic element 35*a* further includes an extension section 39, which is connected to the hanging arm 37 and extended from the corresponding live-wire abutting surface 14*a* toward the main body 36, so as to facilitate the hanging arm 37 to firmly abut against the live-wire abutting surface 14*a* and increase the structural strength of the first elastic element 35*a*. Certainly, the present disclosure is not limited thereto. The socket 20 further includes three conductive pins. Preferably but not exclusively, the three conductive pins include a live-wire pin 22*a*, a neutral-wire pin 22*b* and an earth-wire pin 22*c* extended from the first side 201 to the third side 203 opposite to the first side 201, along the X-axis direction. The live-wire pin 22*a*, the live-wire fixing surface 23*a* and the fixed portion 38 of the first elastic element 35*a* are electrically connected by riveting. The neutral-wire pin 22*b*, the neutral-wire fixing surface 23*b* and the fixed portion 38 of the second elastic element 35*b* are electrically connected by riveting. The earth-wire pin 22*c*, the earth-wire fixing surface 23*c* and the fixed portion 38 of the first elastic element 35*c* are electrically connected by riveting. In other words, the first elastic element 35*a*, the second elastic element 35*b* and the third elastic element 35*c* are pre-fixed on the socket 20. In the embodiment, the first elastic element 35*a* and the second elastic element 35*b* are arranged in parallel to the X-axis direction. A minimum distance D1 is maintained between the first elastic element 35*a* and the second elastic element 35*b*, so as to ensure that the minimum distance D1 maintained between the first elastic element 35*a* and the second elastic element 35*b* meets the safety requirements for electrical clearance and creepage distance. In addition, the third elastic element 35*c* is extended from the first side 201 of the socket 20 along the bottom of the socket 20 and is led out from the second side 202. The length or the shape of the main body 36 is not limited thereto. In the embodiment, the minimum distance D2 formed between the first elastic element 35*a* and the third elastic element 35*c*, and the minimum distance D3 formed between the second elastic element 35*b* and the third elastic element 35*c* meet the safety requirements of electrical clearance and creepage distance. Since the third elastic sheet 35*c* is passed through the socket 20 and led out from the second side 202 of the socket 20. In other embodiments, the electrical clearance and the creepage distance between the third elastic sheet 35*c* and the first elastic element 35*a* or the electrical clearance and the creepage distance between the third elastic sheet 35*c* and the second elastic element 35*b* is increased by the insulation structure design of the socket 20. The present disclosure is not limited thereto, and not redundantly described hereafter.

In summary, the present disclosure provides a power adapter assembly structure. By utilizing the elastic element to connect the socket and the circuit board, the assembling procedure is simplified, the automated production is realized, and the EMI/RFI caused by the crossed leading wires is avoided at the same time. With one-piece formed elastic element connected between a fixing surface and an abutting surface formed by the socket and the circuit board, a stable electronical connection of the socket and the circuit board are achieved. When the elastic element is pressed against the corresponding abutting surface constantly through the hanging arm thereof, the included angle between the hanging arm and the main body is for example an acute angle, so as to provide the elastic force and increase the structural strength. Since the hanging arm of the elastic element is pressed to constantly abut the corresponding abutting surface by the elastic force generated during assembling the socket and the circuit board, the assembling procedure of the socket and the circuit board is combined to realize the assembly structure of the socket, the circuit board and the elastic element by the automatic assembling equipment, and ensure the electrical connection between the socket and the circuit board. The elastic elements are configured to form the electrical connections between the socket and the circuit board, which are for example connected to the live wire, the neutral wire and the earth wire. Two elastic elements connected to the live wire and the neutral wire are led out from the rear side of the socket and arranged in parallel, so as to ensure that the minimum distance maintained between the two elastic elements meets the safety requirements for electrical clearance and creepage distance. In addition, the elastic element connected to the earth wire is led out from the lateral side of the socket to further ensure that the three elastic elements meet the safety requirements of electrical clearance and creepage distance. It avoids electrical EMI/RFI interference caused by crossed wires. On the other hand, since the electrical connections between the socket and the circuit board are realized through the elastic elements with structural strength, and integrated with the assembling procedure of the socket and the circuit board, it is more helpful to realize the assembly structure of the socket, the circuit board and the elastic elements by an automated production method. The assembling procedure is simplified, the production cost is reduced, and the competitiveness of the product is enhanced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power adapter assembly structure, comprising:

a circuit board;

a socket disposed adjacent to the circuit board, wherein the circuit board comprises at least one abutting surface, and the socket comprises at least one fixing surface; and at least one elastic element connected between the circuit board and the socket, and comprising a main body, a fixed portion and a hanging arm, wherein the fixed portion and the hanging arm are disposed at two opposite ends of the main body, the fixed portion of the at least one elastic element spatially corresponds to the at least one fixing surface of the socket, and the hanging arm of the at least one elastic element constantly abuts the at least one abutting surface of the circuit board, wherein a height is formed between the main body of the at least one elastic element and the at least one abutting surface, and the height is less than a length of the hanging arm extended from the main body.

2. The power adapter assembly structure according to claim 1, further comprising a housing, wherein the circuit board and the socket are fastened on the housing, the at least one abutting surface is located at a bottom surface of the circuit board, and the at least one fixing surface is located at a first side of the socket.

3. The power adapter assembly structure according to claim 2, wherein the at least one abutting surface comprises a live-wire abutting surface and a neutral-wire abutting surface located at a surface of the circuit board, and the at least one elastic element comprises a first elastic element and a second elastic element, wherein the hanging arm of the first elastic element constantly abuts the live-wire abutting surface, and the hanging arm of the second elastic element constantly abuts against the neutral-wire abutting surface.

4. The power adapter assembly structure according to claim 3, wherein the at least one fixing surface comprises a live-wire fixing surface and a neutral-wire fixing surface located at the first side of the socket, and the fixed portion of the first elastic element is connected to the live-wire fixing surface, and the fixed portion of the second elastic element is connected to the neutral-wire fixing surface, wherein the first elastic element and the second elastic element are arranged parallel to each other.

5. The power adapter assembly structure according to claim 4, wherein the at least one abutting surface further comprises an earth-wire abutting surface located at the surface of the circuit board, and the at least one elastic element further comprises a third elastic element, wherein the hanging arm of the third elastic element constantly abuts against the earth-wire abutting surface.

6. The power adapter assembly structure according to claim 5, wherein the at least one fixing surface further comprises an earth-wire fixing surface located at the first side of the socket, and the fixed portion of the third elastic element is connected to the earth-wire fixing surface.

7. The power adapter assembly structure according to claim 6, wherein the main body of the third elastic element is extended from the first side to a second side, wherein the main body of the third elastic element, the main body of the second elastic element and the main body of the third elastic element are spaced apart from each other.

8. The power adapter assembly structure according to claim 6, wherein the socket further comprises three conductive pins extended from the first side to a third side opposite to the first side, and the live-wire fixing surface, the neutral-wire fixing surface and the earth-wire fixing surface are electrically connected to the three conductive pins, respectively.

9. The power adapter assembly structure according to claim 1, wherein the hanging arm and the main body form an included angle, and the included angle is an acute angle.

10. The power adapter assembly structure according to claim 1, wherein the at least one elastic element further comprises an extension section connected to the hanging arm, and extended from the corresponding one of the at least one abutting surface toward the main body.

* * * * *